US007216630B2

(12) United States Patent
Martin et al.

(10) Patent No.: US 7,216,630 B2
(45) Date of Patent: May 15, 2007

(54) SYSTEM AND METHOD TO CONTROL SPOOL STROKE MOTION

(75) Inventors: Steffen Martin, Columbia, SC (US); Ryan Peacock, Irmo, SC (US); Robert Straub, Lowell, MI (US)

(73) Assignee: Siemens Diesel Systems Technology, Blythwood, SC (US)

( * ) Notice: Subject to any disclaimer, the term of this patent is extended or adjusted under 35 U.S.C. 154(b) by 92 days.

(21) Appl. No.: 10/969,047

(22) Filed: Oct. 21, 2004

(65) Prior Publication Data

US 2006/0086340 A1 Apr. 27, 2006

(51) Int. Cl.
*F02M 37/04* (2006.01)

(52) U.S. Cl. ..... 123/467

(58) Field of Classification Search ..... 123/446, 123/467, 497, 499, 478, 490; 251/129.1, 251/129.15, 129.18

See application file for complete search history.

(56) References Cited

U.S. PATENT DOCUMENTS 4,327,695 A * 5/1982 Schechter ..... 123/504
4,791,809 A * 12/1988 Schmidt ..... 73/119 A
5,237,968 A * 8/1993 Miller et al. ..... 123/90.11
5,722,373 A * 3/1998 Paul et al. ..... 123/446
6,102,009 A * 8/2000 Nishiyama ..... 123/490
6,283,095 B1 * 9/2001 Krueger ..... 123/499
6,374,783 B1 * 4/2002 Toriumi ..... 123/90.11
RE37,807 E * 7/2002 Shinogle et al. ..... 123/480
6,474,353 B1 * 11/2002 Sturman et al. ..... 137/1
6,513,502 B1 * 2/2003 Sunwoo et al. ..... 123/494
6,866,204 B2 * 3/2005 Becker et al. ..... 239/5
6,925,975 B2 * 8/2005 Ozawa et al. ..... 123/90.11
6,964,263 B2 * 11/2005 Xi et al. ..... 123/499
2003/0154956 A1 * 8/2003 Eckerle et al. ..... 123/357
2004/0083993 A1 * 5/2004 Seale et al. ..... 123/90.11

* cited by examiner

*Primary Examiner*—Thomas Moulis
(74) *Attorney, Agent, or Firm*—McGuireWoods LLP

(57) ABSTRACT

An oil activated fuel injector which provides a pilot quantity of fuel prior to the main fuel injection event. A control system for a fuel injector includes a sensor for providing a signal to a control which is indicative of an opening motion of a spool. The control initiates a pull back of the spool, upon receipt of the signal, to eliminate a bounce back phenomenon of the spool during an injection of a pilot quantity of fuel. The signal may be representative of a pressure of working fluid or fuel, as well as a position or acceleration of the spool.

33 Claims, 3 Drawing Sheets

SYSTEM AND METHOD TO CONTROL SPOOL STROKE MOTION

BACKGROUND OF THE INVENTION

1. Field of the Invention

The invention generally relates to oil activated fuel injectors and, more particularly, to a system and method to control spool stroke in oil activated electronically or mechanically controlled fuel injectors.

2. Background Description

There are many types of fuel injectors designed to inject fuel into a combustion chamber of an engine. For example, fuel injectors may be mechanically, electrically or hydraulically controlled in order to inject fuel into the combustion chamber of the engine. In the hydraulically actuated systems, a control valve body may be provided with two, three or four way valve systems, each having grooves or orifices which allow fluid communication between working ports, high pressure ports and venting ports of the control valve body of the fuel injector and the inlet area. The working fluid is typically engine oil or other types of suitable hydraulic fluid which is capable of providing a pressure within the fuel injector in order to begin the process of injecting fuel into the combustion chamber.

In current designs, a driver will deliver a current or voltage to an open side of an open coil solenoid. The magnetic force generated in the open coil solenoid will shift a spool into the open position so as to align grooves or orifices (hereinafter referred to as "grooves") of the control valve body and the spool. The alignment of the grooves permits the working fluid to flow into an intensifier chamber from an inlet portion of the control valve body (via working ports). The high pressure working fluid then acts on an intensifier piston to compress an intensifier spring and hence compress fuel located within a high pressure plunger chamber. As the pressure in the high pressure plunger chamber increases, the fuel pressure will begin to rise above a needle check valve opening pressure. At the prescribed fuel pressure level, the needle check valve will shift against the needle spring and open the injection holes in a nozzle tip. The fuel will then be injected into the combustion chamber of the engine.

However, in such a conventional system, the spool has a tendency to bounce or repeatedly impact against the open coil during the opening stroke. During this bouncing, it is difficult to control the spool motion and hence results in the inability to efficiently control the supply of fuel to the combustion chamber of the engine. For example, in conventional systems it is not possible to quickly move the spool away from the open coil in order to minimize the bouncing effect during an injection of a pilot quantity of fuel. Accordingly, the initial quantity of fuel provided during the pre-stroke event cannot be easily controllable, resulting in a larger injection quantity of fuel than desired.

This may result in a retarded start of injection, as well as the inability to control the spool and hence the injection of a small, pilot quantity of fuel. That is, during this bouncing or repeated impact, a small quantity (pilot injection) of fuel cannot be metered accurately in order to efficiently inject this pilot quantity of fuel into the combustion chamber of an engine. Additionally, it is also very difficult, if not impossible, to vary the amount of fuel during this pilot injection.

It is also known that the bouncing phenomenon may differ from injector to injector, and over time. For example, different manufacturing tolerances may affect the bouncing phenomenon from, for example, small variations in spool diameter to different coil characteristics. Additionally, over time, in the same injector, variations may result from different operating conditions such as temperature and wear on the parts due to aging and other factors. Thus, the control of fuel quantity may vary from fuel injector to fuel injector, as well as over time with the same fuel injector. This also may lead to higher emissions and engine noise.

In some systems, to provide a smaller quantity of fuel, a delay of the pre-stroke of the plunger is provided. But, in conventional systems this is provided by adding more working fluid, under high pressure, into the injector. The additional pressurized working fluid may cause the appropriate delay; however, additional energy from the high pressure oil pump must be expanded in order to provide this additional working fluid. This leads to an inefficiency in the operations of the fuel injector, itself, and also does not provide a consistent supply of fuel into the engine. Also, this delay does not compensate for variations in fuel injector characteristics over time or from fuel injector to fuel injector, nor does this take into consideration the bouncing effect phenomenon. Thus, this delay may not be an accurate, controllable method for providing small quantities of fuel into the combustion chamber of an engine.

The invention is directed to overcoming one or more of the problems as set forth above.

SUMMARY OF THE INVENTION

In a first aspect of the invention, a control system for a fuel injector includes a means for providing a signal to a control which is indicative of an opening motion of a spool. The control initiates a pull back of the spool, upon receipt of the signal, to eliminate a bounce back phenomenon of the spool during an injection of a pilot quantity of fuel. The signal may be representative of a pressure of working fluid or fuel, as well as a position or acceleration of the spool. In further embodiments, the signal may be representative of a back EMF, which may be used to determine a position of the sensor.

In another aspect of the invention, a control system of a fuel injector includes a sensor which generates a signal representative of an opening motion of a spool at time $t_0$. A control initiates a pull back current to be applied to a non-active coil at a calculated time $t_1$ to eliminate bouncing effects on a surface of an active coil and provide metering of a pilot quantity of fuel, where $t_1 > t_0$.

In yet another aspect of the invention, a fuel injector includes a spool slidable between an open coil and closed coil. An intensifier body is positioned proximate to the spool, and a piston assembly is slidably positioned within the intensifier body. A high pressure chamber is formed below the piston assembly, while a fuel bore supplies fuel to a nozzle in fluid communication with the high pressure chamber. A control initiates a pull back current to the closed coil at a calculated time $t_1$ to eliminate bouncing effects on a surface of the open coil and provide metering of a pilot quantity of fuel.

In another aspect of the invention, a method is provided for controlling a spool motion. The method includes determining a position of the spool after a current is applied to an opening coil and initiating a pull back current on a closed coil based on the position of the spool. This current pulls back the spool after initial contact with the open coil and prior to any bouncing effects to thus provide a pilot quantity of fuel.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

The invention is directed to a method and system of controlling the motion or stroke of the spool and preventing bouncing effects against the solenoid coils in oil activated electronically, mechanically or hydraulically controlled fuel injectors during injection of pilot quantities of fuel, typically in the ranger of 1 $mm^3$. Other injection quantities are also contemplated with the invention, including main injection quantities. The elimination or control of the bouncing effect during an injection of a pilot quantity of fuel allows a more controlled injection event prior to the main injection event. The invention will thus increase efficiency of the injection cycle and decrease engine noise and engine emissions. To accomplish the advantages of the invention, in embodiments, the invention is capable of determining or detecting the position of the spool and, in one embodiment, the impact of the spool on the open coil or travel time of the spool. By knowing this information, the control of the invention can provide a current to the closed coil side in order to provide a pull back of the spool thus eliminating the bouncing effect phenomenon during a pre-stroke event.

Embodiments of the Oil Activated Fuel Injector of the Invention

Figure 1:
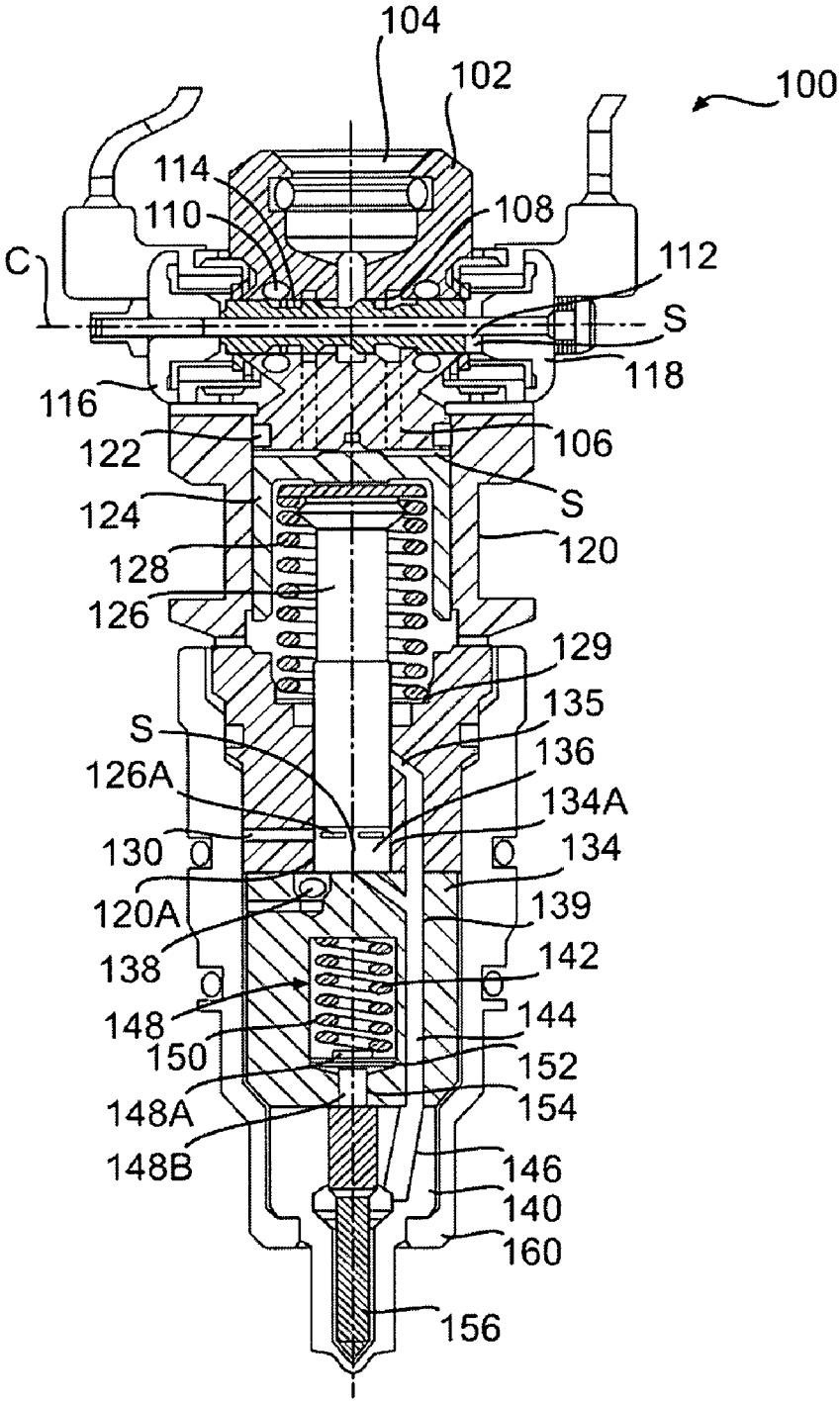
FIG. 1 shows an oil activated fuel injector of the invention.

Referring now to FIG. 1, an overview of a fuel injector in accordance with the invention is shown. It should be understood, though, that the injector shown in FIG. 1 is provided as one illustrative example, and that other configurations, features and the like may also be equally used with the invention. Accordingly, the fuel injector of FIG. 1 and the features described herein are not to be considered a limiting feature of the invention.

The fuel injector is generally depicted as reference numeral 100 and includes a control valve body 102 as well as an intensifier body 120 and a nozzle 140. The control valve body 102 includes an inlet area 104 which is in fluid communication with working ports 106. At least one groove or orifice (hereinafter referred to as grooves) 108 is positioned between and in fluid communication with the inlet area 104 and the working ports 106. At least one of vent hole 110 (and preferably two ore more) is located in the control body 102 which is in fluid communication with the working ports 106.

A spool 112 having at least one groove or orifice (hereinafter referred to as grooves) 114 is slidably mounted within the control valve body 102. An open coil 116 and a closed coil 118 are positioned on opposing sides of the spool 112 and are energized via a driver (not shown) to drive the spool 112 between a closed position and an open position. In the open position, the grooves 114 of the spool 112 are aligned with the grooves 108 of the valve control body 102 thus allowing the working fluid to flow between the inlet area 104 and the working ports 106 of the valve control body 102.

Still referring to FIG. 1, the intensifier body 120 is mounted to the valve control body 102 via any conventional mounting mechanism. A seal 122 (e.g., o-ring) may be positioned between the mounting surfaces of the intensifier body 120 and the valve control body 102. A piston 124 is slidably positioned within the intensifier body 120 and is in contact with an upper end of a plunger 126. An intensifier spring 128 surrounds a portion (e.g., shaft) of the plunger 126 and is further positioned between the piston 124 and a flange or shoulder 129 formed on an interior portion of the intensifier body 120. The intensifier spring 128 urges the piston 122 and the plunger 126 towards a first position proximate to the valve control body 102. A pressure release hole 130 is formed in the body of the intensifier body 120. The pressure release hole 130 may be further positioned adjacent the plunger 126.

As further seen in FIG. 1, a check disk 134 may be positioned below the intensifier body 120 remote from the valve control body 102. The combination of an upper surface 134*a* of the check disk 134, an end portion 126*a* of the plunger 126 and an interior wall 120*a* of the intensifier body 120 forms the high pressure chamber 136. A fuel inlet check valve 138 is positioned within the check disk 134 and provides fluid communication between the high pressure chamber 136 and a fuel area (not shown). This fluid communication allows fuel to flow into the high pressure chamber 136 from the fuel area during an up-stroke of the plunger 126. The pressure release hole 130 is also in fluid communication with the high pressure chamber 136 when the plunger 126 is urged into the first position; however, fluid communication is interrupted when the plunger 126 is urged downwards towards the check disk 134. The check disk 134 also includes a fuel bore 139 in fluid communication with a fuel bore 135 in the intensifier body 120. The fuel bore 135 is in fluid communication with the high pressure chamber 136.

FIG. 1 further shows the nozzle 140 and a spring cage 142. The spring cage 142 is positioned between the nozzle 140 and the check disk 134, and includes a fuel bore 144 in fluid communication with the fuel bore 139 of the check disk 134. The spring cage 142 also includes a centrally located bore 148 having a first bore diameter 148*a* and a second smaller bore diameter 148*b*. A spring 150 and a spring seat 152 are positioned within the first bore diameter 148*a* of the spring cage 142, and a pin 154 is positioned within the second smaller bore diameter 148*b*. The nozzle 140 includes an angled bore 146 in alignment with the bore 139 of the spring cage 142. A needle 150 is preferably centrally located with the nozzle 140 and is urged downwards by the spring 150 (via the pin 154). A fuel chamber 152 surrounds the needle 150 and is in fluid communication with the bore 146. In embodiments, a nut 160 is threaded about the intensifier body 120, the check disk 134, the nozzle 140 and the spring cage 142.

Still referring to FIG. 1, a control "C" is used to control and monitor different parameters of the injector 100. The control "C" may, for example, control, monitor and/or regulate the current provided to the open coil 1116 and closed coil 118. In this way, the control "C" can control, monitor and/or regulate the movement of the spool 112 between a closed position and an open position. By way of example, the electronic properties e.g., back EMF (electro magnetic force), of the closed coil 1118 or the open coil can be monitored by the control "C" (while the open coil is energized). The resultant signals can then be used to estimate the movement of the spool valve in either direction. By using these signals, changes of the spool motion over the lifetime of the injector can be compensated for due to, for example, temperature changes, wear conditions, magnetic properties, all surface related effects (adhesion, cohesion, friction), fluctuations in working fluid pressure and the like, by adjusting the timing values for the open coil and close coil, e.g., adjusting the timing of the current provided to the open coil and closed coil. Additionally, by determining the position of the spool, it is now possible to eliminate the bouncing effects during an injection event of the pilot quantity of fuel, as discussed in further detail below. In addition, changes over lifetime injector to injector variations can be compensated for with use of the invention.

As should be known to those of skill in the art, inductance is a property associated with the wire wound about the open coil or the closed coil. The origin of inductance is that the current flowing through the wire builds up a magnetic field around the wire. Energy is stored in this field and when the current changes in the coil, some energy must be transferred to or from the field which occurs by the field causing a voltage drop across the conductor while the current is changing. The voltage drop (back EMF) will be proportional to the derivative of the current change over time, and the sign of the voltage will be such as to try to resist the change in current. By monitoring this back EMF, an indication of the position of the spool can then be obtained (by knowing the current provided to the open coil and the distance the spool must travel to the open coil).

By knowing the position of the spool, a current can then be provided to the closed coil, at a predetermined time, $t_1$, to reverse the motion of the spool after initial impact (this reversal could even be initiated before initial impact) with the surface of the open coil. In this way, the spool will be pulled back, eliminating the bouncing effect on the surface of the open coil. In one application the back-EMF trace will be recorded and saved in the electronics for a certain application. Then, the measured signal will be compared to the stored trace, with the signal strength identifying the location of the spool.

In addition, a sensor "S" may monitor, for example, (i) a pressure drop of working fluid within the injector below the spool, (ii) a pressure drop of working fluid in the working fluid rail or the reservoir, (iii) a pressure increase or decrease of fuel in the high pressure chamber and/or (iv) an acceleration of the spool 112. For example, a pressure sensor "S" may be used to monitor the pressure of the working fluid in the rail, the reservoir or below the spool, as well as monitoring the fuel pressure in the high pressure chamber. The sensor "S" may also be a positional sensor to determine the precise position of the spool as it contacts or is about to contact the surface of the open coil. Additionally, the sensor "S" may be accelerometer used to determine acceleration of the spool, which is monitored by the control "C".

In any of these examples, the sensor "S" will act as an input (e.g., provide an input signal) to the control "C." The control "C", upon receipt of the signal, may then provide correction, monitoring or adjustment of the metering of fuel into the combustion chamber of an engine. By way of example, operating electronically, the pressure sensor "S" can send a varying voltage signal to the control "C" in response to changes in pressure. As should be understood by those of skill in the art, this pressure change is indicative of an initial opening of the spool at $t_0$. for example, upon the opening of the spool at time $t_0$, any of the following may result:

(i) the working fluid pressure in fuel rail or reservoir will decrease, (ii) the working fluid pressure below the spool and more particularly above the plunger will increase, or (iii) the fuel pressure within the high pressure chamber will increase due to the working fluid acting on the piston and plunger assembly.

These pressure changes will be monitored by the sensor "S" which, in turn, will provide a signal to the control "C". The control can then calculate or determine the precise opening time of the spool and hence location of the spool at time $t_0$. Based on known or historical information such as, for example, the speed of the spool, e.g., approximately 1.2 m/s, and the distance of travel or location, e.g., approximately 440 μm, with respect to the position of contact with the surface of the open coil, it is possible to calculate the time it will precisely take to contact the surface of the open coil, e.g., approximately 300 μs, using the following simplified equation as an approximation:

$$\text{Time (s)}=\text{Distance (m)}/\text{Velocity (m/s)}$$

Similarly, it is also possible to calculate any position of the spool knowing historically, the time it takes for the spool to make contact with the surface of the open coil, knowing the distance of travel and the initial opening time. Also, using the accelerometer, it is possible to determine the time of impact on the surface of the open coil knowing the acceleration and distance of travel of the spool using the following equation:

$$\text{Time (s)}=\sqrt{2\times\text{Distance(m)}/\text{Acceleration(m/s}^2)}$$

Alternatively, and most conveniently, the position sensor can simply provide input to the control "C" as to the exact position of the spool. Sensors that may be used with the invention include, for example, hall effect sensors, induction sensors, resistance sensor.

Thus, once the position of the spool is determined, for example, the current to the open coil or the closed can be adjusted, e.g., adjusting the timing of the current, to change the motion or position of the spool. That is, the current to the closed coil can be initiated while the current to the open coil is terminated. This can be used to eliminate the bouncing phenomenon and to control and meter the pilot quantity of fuel more accurately. That is, by providing a current to the closed coil prior to or at the substantially exact time of contact between the spool and the surface of the open coil, it is now possible to reverse the motion of the spool away from the open coil to prevent the bouncing of the spool against the open coil. Also, using these methods, as discussed in more detail below, it is also possible to adjust the quantity of injected fuel based on different characteristics of the fuel injector, over time.

In one example, a "pull back" current can be applied to the closed coil side upon initial impact or prior to initial impact at time $t_1$ of the spool on the surface of the open coil, thus pulling back the spool towards the closed coil and away from open the coil prior to any bouncing. This "pull back" current can eliminate the bouncing effect and thus assist in the control and metering of the fuel more accurately. Also, by changing the current, the injection quantity can be adjusted at any time during the injection event. Accordingly, by way of example, when the control "C" stops or adjusts the current to the open coil or closed coil a very precise quantity of fuel between injection events, different fuel injectors and over time for a single fuel injector can be provided, as described in more detail with reference to FIG. 2 and FIG. 3.

Figure 2:
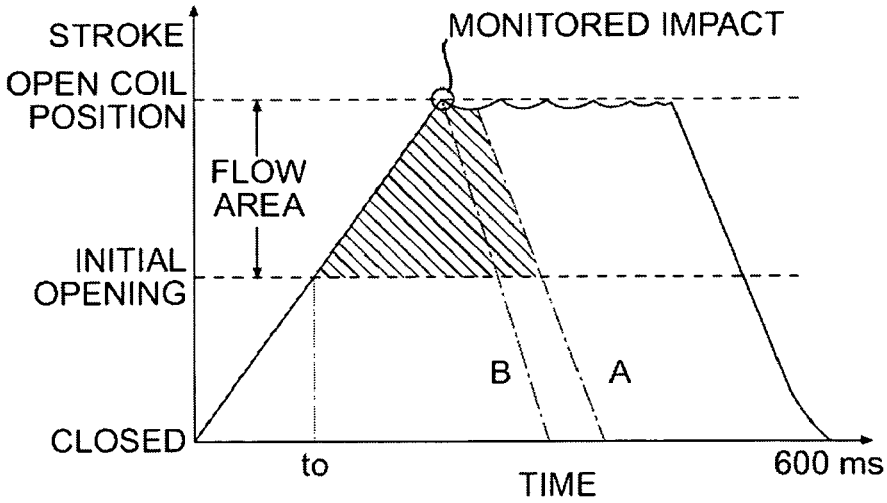
FIG. 2 shows a graph depicting an adjustment of a pilot quantity of fuel.

FIG. 2 is a graph depicting an injection event. In FIG. 2, the y-axis represents the stroke of the spool and the x-axis represents time. In this graph, the solid line is an ordinary injection event with a bouncing effect or phenomenon and the dashed line "A" is representative of an injection of a pilot quantity of fuel with the bouncing effect. In contrast, the dashed line "B" represents an injection of a pilot quantity of fuel without the bouncing effect in accordance with the invention.

In particular, upon energizing the open coil, the spool will begin to move towards the open coil resulting in an initial injection at time $t_0$. In one embodiment, $t_0$ is approximately 300 μs. At $t_0$, the initial flow will begin and a pressure decrease will result in the rail or reservoir. Also, at $t_0$, a pressure increase in fuel will result in the fuel chamber, as well as a pressure increase in the working fluid under the spool. This will be an indication of the movement and/or position of the spool. Referring to the solid line, a bouncing effect of the spool occurs when the spool contacts the open coil. During this bouncing effect, it is difficult to control the closing of the spool. That is, only after the bouncing effect has begun, is it possible to move the spool into the closed position. According, the initial quantity of fuel provided during the injection event cannot be easily controllable, resulting in a larger injection quantity of fuel than desired, as shown by the shaded area under the curve of dashed line "A".

However, in accordance with the invention, referring to dashed line "B", the bouncing effect can be eliminated during the injection of a pilot quantity of fuel. That is, the closing of the spool can be controlled by monitoring, for example, the back EMF, the working fluid or fuel pressure or the acceleration of the spool, itself. In this manner, it is possible to decrease or more precisely and accurately meter the amount of fuel during an initial injection event. Also, by using the method and system of the invention, it possible to control the injection event, e.g., adjust the fuel quantity, based on different operating parameters such as, for example, temperature conditions, wear conditions and the like over the lifetime of the fuel injector, and from fuel injector to fuel injector.

By way of example, by knowing the precise time of the initial contact of the spool on the open coil, the methods and system of the invention can shut off the fuel flow by precisely timing the application of current to the closed coil. This, in turn, will move the spool into the closed position at the time of initial impact thus eliminating the bounce shown in line "A," and hence allowing the system to provide a more precise and controllable injection event. Thus, by moving the spool towards the closed coil immediately upon initial impact with the open coil, a smaller or more controllable pilot quantity of fuel can be provided during the initial injection event. This can be performed regardless of the operating conditions and fuel injector.

Figure 3:
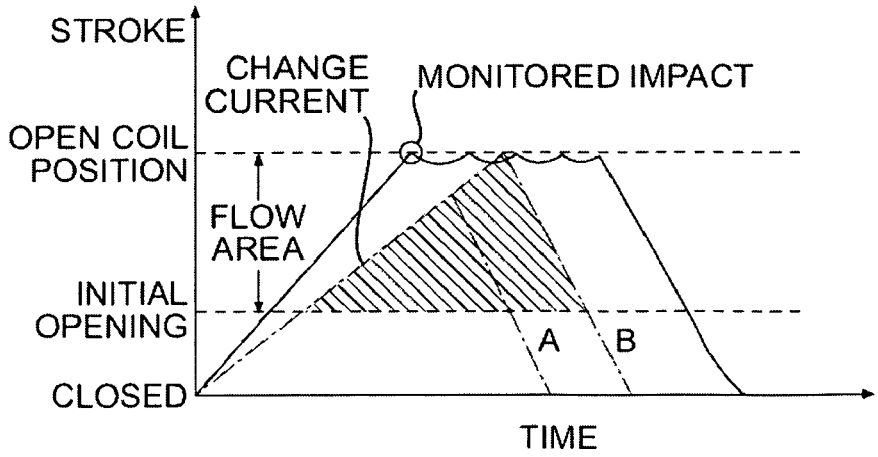
FIG. 3 shows a graph depicting an adjustment of a pilot quantity of fuel.

FIG. 3 shows another graph depicting an injection event. Similar to the graph of FIG. 2, the solid line is an ordinary injection event with a bouncing effect or phenomenon and the dashed line "A" is representative of an injection of a pilot quantity of fuel with the bouncing effect. In contrast, the dashed line "B" represents an injection of a pilot quantity of fuel without the bouncing effect in accordance with the invention.

Referring to the dashed line "B" of FIG. 3, by anticipating the impact time using, for example, historical information obtained from previous injection events, the current of the open coil can be adjusted. In this manner, the slope of the curve of dashed line "B" is moved showing that a different quantity of fuel may be provided, again with the elimination of the bouncing effect. This different quantity of fuel is represented by the shaded area under the curve of dashed line "B". Accordingly, the pilot quantity of fuel provided during the injection event can now be controlled by adjusting the current of the open coil. This allows a designer to adjust the injection quantity for different fuel injector conditions.

Figure 4:
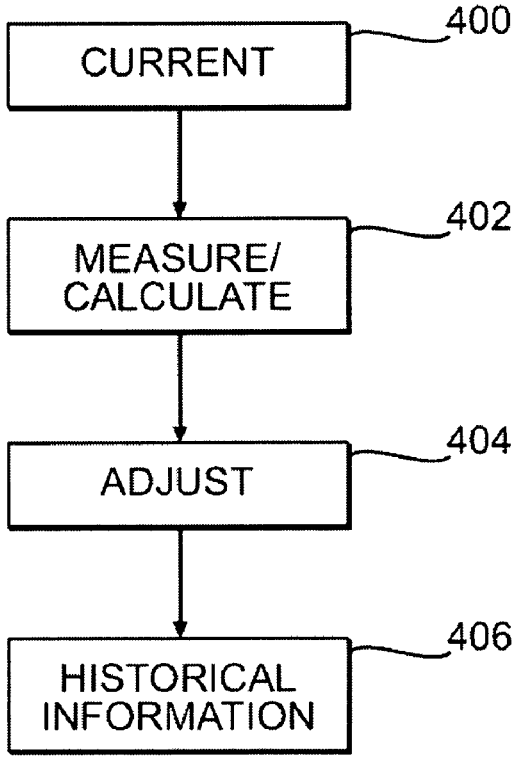
FIG. 4 shows a flow chart in accordance with a process of implementing the invention.

FIG. 4 is a flow chart showing the steps of an embodiment of the invention. At step 400, a current is applied to the open coil. At step 402, a measured or calculated parameter is provided to the control "C". This parameter may be, for example, the back EMF, a change in pressure in the working fluid or the fuel, an acceleration of the spool or an initial contact of the spool on the surface of the open coil. In one embodiment, this parameter may be a historical value of any of the previous parameters over any number of characteristic changes such as, for example, temperature changes and the like. This information is then used by the control "C" to initiate an adjustment of the current in the closed coil to provide a pull back of the spool away from the open coil and towards the closed coil, at step 404. By providing this pull back current, it is possible to control the movement of the spool and hence the pilot quantity of fuel.

At optional step 404, the information can be saved by the control "C" to be used as historical information. This historical information can then be used to adjust the current in the open coil or the closed coil, depending on a particular fuel injector characteristic. Also, using this historical data, it may be possible to achieve even greater response times, knowing when the bouncing effects occurred in previous injection cycles and using this information to anticipate such events prior to even the initial impact of the spool on the surface of the open coil.

Operation of the Oil Activated Fuel Injector of the Invention

In operation, a driver (not shown) will first energize the open coil 116. The energized open coil 116 will create a magnetic force which will then shift the spool 112 from a start position to an open position. In the open position, the grooves 108 of the control valve body 102 will become aligned with the grooves 114 on the spool 112. The alignment of the grooves 108 and 114 will allow the pressurized working fluid to flow from the inlet area 104 to the working ports 106 of the control valve body 102.

Once the pressurized working fluid is allowed to flow into the working ports 106 it begins to act on the piston 124 and the plunger 126. That is, the pressurized working fluid will begin to push the piston 124 and the plunger 126 downwards thus compressing the intensifier spring 128. As the piston 124 is pushed downward, fuel in the high pressure chamber will begin to be compressed via the end portion **126*a*** of the plunger. Due to the pressure on the piston and the intensifier ratio to the plunger (e.g., 7:1), the fuel in the high-pressure chamber and the dead volume towards the nozzle will reach a certain pressure level. When the fuel reaches a certain pressure level, the needle shifts against the needle spring and opens the injection holes in the nozzle tip. During this pre-stroke cycle, a pilot quantity of fuel can then be injected into the engine thus reducing emissions and engine noise. The pre-stroke distance is preferably 10% to 30% of the plunger stroke.

To prevent bouncing effects and to more accurately meter the fuel during the injection of the pilot quantity of fuel, at initial contact or at some predetermined time prior to initial contact of the spool with the surface of the open coil, a current will be applied to the closed coil. This current will pull back the spool during the injection event and preferably during the injection of a pilot quantity of fuel. The position of the spool can be determined using any of the methods described above, including back EMF, historical data or the sensed pressure of working fluid or fuel, for example. Due to the pull back of the spool at the predetermined time, the bouncing effect will not occur, allowing a more precise metering of the pilot quantity of fuel. It should be understood that each injector and each shot based on certain conditions can change this initial impact on the open coil. Therefore, by monitoring the spool motion with, for example, back EMF, it is possible to adjust the pulling back of the spool based on monitored initial impact.

To end the injection cycle, the driver will energize the closed coil 118. The magnetic force generated in the closed coil 118 will then shift the spool 112 into the closed or start position which, in turn, will close the working ports 106 of the control valve body 102. That is, the grooves 108 and 114 will no longer be in alignment thus interrupting the flow of working fluid from the inlet area 104 to the working ports 106. At this stage, the needle spring 150 will urge the needle 156 downward towards the injection holes of the nozzle 140 thereby closing the injection holes. Similarly, the intensifier spring 128 urges the plunger 126 and the piston 124 into the closed or first position adjacent to the valve control body 102. As the plunger 126 moves upward, the pressure release hole 132 will release pressure in the high pressure chamber 136 thus allowing fuel to flow into the high pressure chamber 136 (via the fuel inlet check valve 138). Now, in the next cycle the fuel can be compressed in the high pressure chamber 136. As the plunger 126 and the piston 124 move towards the valve control body 102, the working fluid will begin to be vented through the vent holes 110.

While the invention has been described in terms of embodiments, those skilled in the art will recognize that the invention can be practiced with modification within the spirit and scope of the appended claims.

We claim:

1. A control system for a fuel injector, comprising a means for providing a signal to a control which is indicative of an opening motion of a spool, the control initiating a pull back of the spool, upon receipt of the signal, to eliminate a bounce back phenomenon of the spool during an injection event.

2. The control system of claim 1, wherein the providing means is a pressure sensor which provides the signal representative of a pressure of working fluid after the opening motion of the spool.

3. The control system of claim 2, wherein the pressure sensor provides the signal based on a pressure drop of the working fluid.

4. The control system of claim 2, wherein the control, upon receipt of the signal, calculates a relative position of the spool in order to initiate a change in current at time $t_1$ to a non-active coil in order to change a motion of the spool.

5. The control system of claim 1, wherein:

the providing means is a pressure sensor which provides the signal representative of a pressure increase of fuel in a high pressure chamber, the pressure increase of fuel being indicative of the opening motion of the spool; and the control, upon receipt of the signal, calculates a relative position of the spool in order to initiate a change in current at time $t_1$ to a non-active coil thereby changing a motion of the spool.

6. The control system of claim 1, wherein:

the providing means is an accelerometer which provides the signal representative of an acceleration of the spool; and the control, upon receipt of the signal, calculates a relative position of the spool in order to initiate a change in current at time $t_1$ to a non-active coil thereby changing a motion of the spool.

7. The control system of claim 1, wherein the providing means generates a signal representative of a back EMF (electromagnetic force) of either a non-active coil or active coil, the control translates the signal representative of the back EMF into a movement of the spool in a direction towards the active coil.

8. The control system of claim 7, wherein the control calculates a relative position of the spool based on the movement and initiates a change in current at time $t_1$ to the non-active coil thereby reversing a direction of the spool.

9. The control system of claim 1, wherein the control initiates a change in current to a non-active coil upon contact or at a time $t_1$ prior to contact of the spool on a surface of an opposing coil, the current provides a pull back the spool from the surface of the opposing coil.

10. The control of claim 1, wherein the control initiates a change in current to an active coil to modify an opening time of the spool and increase an injection quantity of the fuel.

11. The control of claim 1, wherein the control stores historical data received previously from the providing means and uses the historical data to initiate a change of motion of the spool and eliminate the bounce back phenomenon of the spool during an injection of fuel.

12. The control of claim 1, wherein the injection event is a pilot injection quantity of fuel.

13. A control system of a fuel injector, comprising:

a sensor which generates a signal representative of an opening motion of a spool at time $t_0$; and a control which initiates a pull back current to be applied to a non-active coil at a calculated time $t_1$ to eliminate bouncing effects on a surface of an active coil and provide metering of a quantity of fuel, where $t_1 > t_0$.

14. The control system of claim 13, wherein the sensor is any one of a pressure sensor, a positional sensor or an accelerometer.

15. The control system of claim 13, wherein the sensor provides a signal representative of a sensed back EMF of the non-active coil, the control calculates a position of the spool based on the signal of the sensed back EMF.

16. The control system of claim 13, wherein the control initiates a change of current to an active coil to modify an opening time of the spool and increase an injection quantity of the pilot quantity of fuel.

17. The control system of claim 13, wherein the control stores historical data received previously from the sensor and uses the historical data to initiate a change of motion of the spool at time $t_1$ and eliminate the bouncing effects during an injection of the pilot quantity of fuel.

18. The control system of claim 13, wherein the sensor provides a signal representative of a sensed back EMF of the active coil in order to calculate a position of the spool.

19. The control system of claim 13, wherein the quantity of fuel is a pilot injection.

20. A fuel injector comprising:

a spool slidable between an open coil and closed coil;

an intensifier body positioned proximate to the spool;

a piston assembly slidably positioned within the intensifier body;

a high pressure chamber formed below the piston assembly;

a fuel bore for supplying fuel to a nozzle in fluid communication with the high pressure chamber; and a control which initiates pull back current to the closed coil at a calculated time $t_1$ to eliminate bouncing effects on a surface of the open coil and provide metering of an injection event.

21. The fuel injector of claim 20, further comprising a means for providing a signal to the control which is indicative of an opening motion of a spool after time $t_0$, where $t_1>t_0$.

22. The fuel injector of claim 21, wherein the providing means is one of a pressure sensor, a positional sensor, an accelerometer and an electromagnetic force (EMF) sensor.

23. The fuel injector of claim 20, wherein the control, upon receipt of the signal, calculates the position of the spool and based on the calculation initiates a current at time $t_1$ to the closed coil in order to change a motion of the spool away from the open coil.

24. The fuel injector of claim 21, wherein the control stores historical data received previously from the providing means and uses the historical data to initiate a change of motion of the spool at time $t_1$ and eliminate the bouncing effects during the injection event.

25. The fuel injector of claim 24, wherein the injection event is a pilot quantity of fuel.

26. A method of controlling a spool motion, comprising the steps of:

determining a position of the spool after a current is applied to an opening coil; and initiating a pull back current on a closed coil based on the position of the spool to pull back the spool after initial contact with the open coil and prior to any bouncing effects to provide a pilot quantity of fuel.

27. The method of claim 26, wherein the determining step includes sensing a back EMF (electromagnetic force) and using the sensed back EMF to determine the position of the spool.

28. The method of claim 27, further comprising:

providing a signal representative of the sensed back EMF;

calculating a relative position of the spool based on the signal;

initiating a change in current at time $t_1$ to the closed coil to change a motion of the spool based on the calculated relative position.

29. The method of claim 26, wherein the determining step includes sensing a pressure of working fluid of fuel after the opening motion of the spool.

30. The method of claim 29, further comprising providing a signal representative of the sensed pressure;

calculating a relative position of the spool based on the signal;

initiating a change in current at time $t_1$ to the closed coil to change a motion of the spool based on the calculated relative position.

31. The method of claim 26, wherein the determining step includes sensing an acceleration of the spool.

32. The method of claim 31, further comprising providing a signal representative of the acceleration;

calculating a relative position of the spool based on the signal;

initiating a change in current at time $t_1$ to the closed coil to change a motion of the spool based on the calculated relative position.

33. The method of claim 26, further comprising storing historical data associated with the movement of the spool and using the historical data to initiate a change of motion of the spool during an injection of a pilot quantity of fuel.

* * * * *